US006176158B1

(12) United States Patent
Chen

(10) Patent No.: US 6,176,158 B1
(45) Date of Patent: Jan. 23, 2001

(54) PINCERS

(76) Inventor: Jin-Fu Chen, P.O. Box, 2103, Taichung (TW)

( * ) Notice: Under 35 U.S.C. 154(b), the term of this patent shall be extended for 0 days.

(21) Appl. No.: 09/353,618

(22) Filed: Jul. 15, 1999

(51) Int. Cl.[7] ..... B25B 7/06
(52) U.S. Cl. ..... 81/417; 81/416; 81/394
(58) Field of Search ..... 81/407, 408, 385, 81/387, 393–394, 411, 417, 418

(56) References Cited

U.S. PATENT DOCUMENTS 3,575,070 * 4/1971 Nichols ..... 81/417 X
4,669,340 * 6/1987 Igarashi ..... 81/394 X

FOREIGN PATENT DOCUMENTS

974491 * 2/1961 (GB) ..... 81/417

* cited by examiner

*Primary Examiner*—David A. Scherbel
*Assistant Examiner*—Anthony Ojini
(74) *Attorney, Agent, or Firm*—Rosenberg, Klein & Lee

(57) ABSTRACT

A pincers includes two main bodies, a fixing member, a treatment member, a tightening member and a resilient member. By utilizing the treatment member, the fixing member and the resilient member disposed between the main bodies and the fixing member, the pincers has a good mating relationship and can be easily assembled so that the using effect of the pincers is improved.

2 Claims, 9 Drawing Sheets

PINCERS

BACKGROUND OF THE INVENTION

The present invention relates to a pincers in which by means of a fixing member and a resilient member, the jaw sections of the two main bodies are kept in a good mating relationship.

FIGS. 9 and 10 show an existing pincers including two main bodies 9 which are pivotally connected with each other by a rivet 91. A resilient member 93 is disposed between the pivot sections 92 of the main bodies 9. Two ends of the resilient member 93 are respectively inserted into the sockets 94 of the main bodies 9. The resilient member 93 serves to keep the pincers in an open state at normal time.

The above pincers has a hidden resilient member 93. However, the pincers is required to have higher hardness and needs to heat-treated. The material of the resilient member 93 is different from that of the main bodies 9. In the case that they are together heat-treated. The resilient member 93 will become cracky and tend to break. In the case that the main bodies 9 are first heat-treated and then assembled with the resilient member 93, due to quenching, the work piece will be deformed. This will lead to difficulty in assembly. Moreover, the blade sections 95 are hard to match with each other so that after assembled, the shearing effect is poor.

SUMMARY OF THE INVENTION

It is therefore a primary object of the present invention to provide a pincers in which by means of a treatment member, a fixing member and a resilient member disposed between the main bodies and the fixing member, the pincers has a good mating relationship so that the using effect of the pincers is improved.

It is a further object of the present invention to provide the above pincers which can be easily assembled.

The present invention can be best understood through the following description and accompanying drawings wherein:

DETAILED DESCRIPTION OF THE PREFERRED EMBODIMENTS

Figure 1:
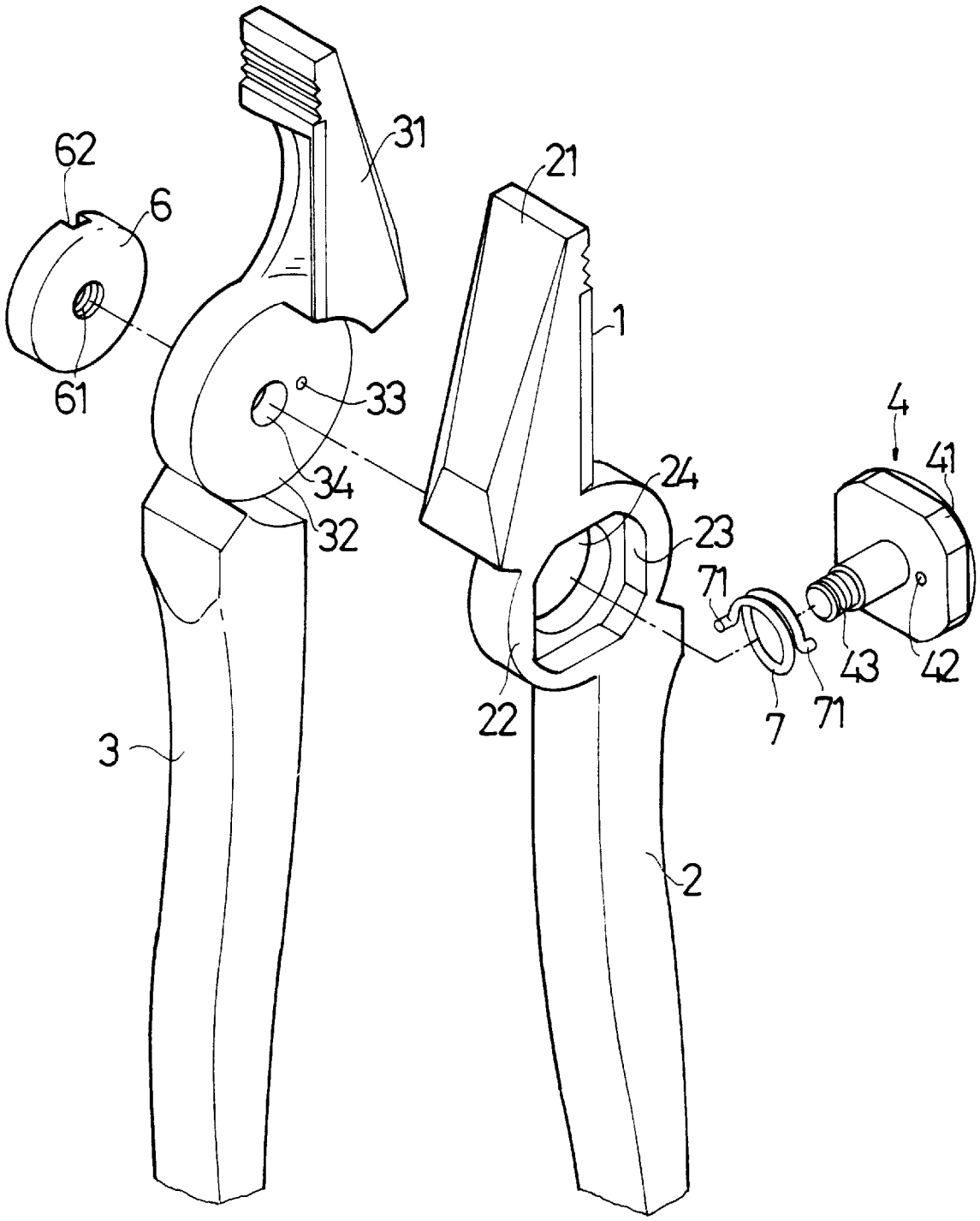
FIG. 1 is a perspective exploded view of a first embodiment of the present invention.
Figure 2:
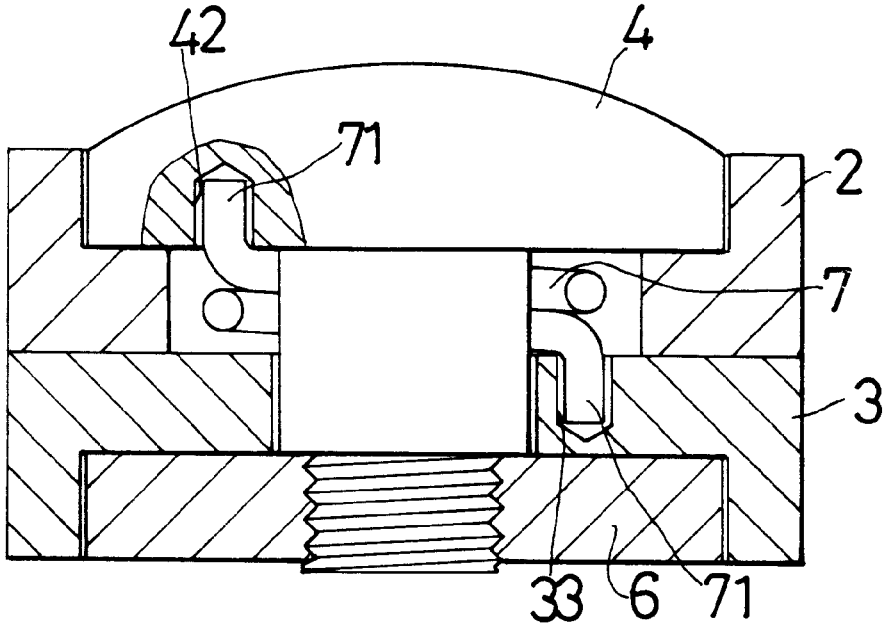
FIG. 2 is a sectional view of the first embodiment of the present invention.
Figure 3:
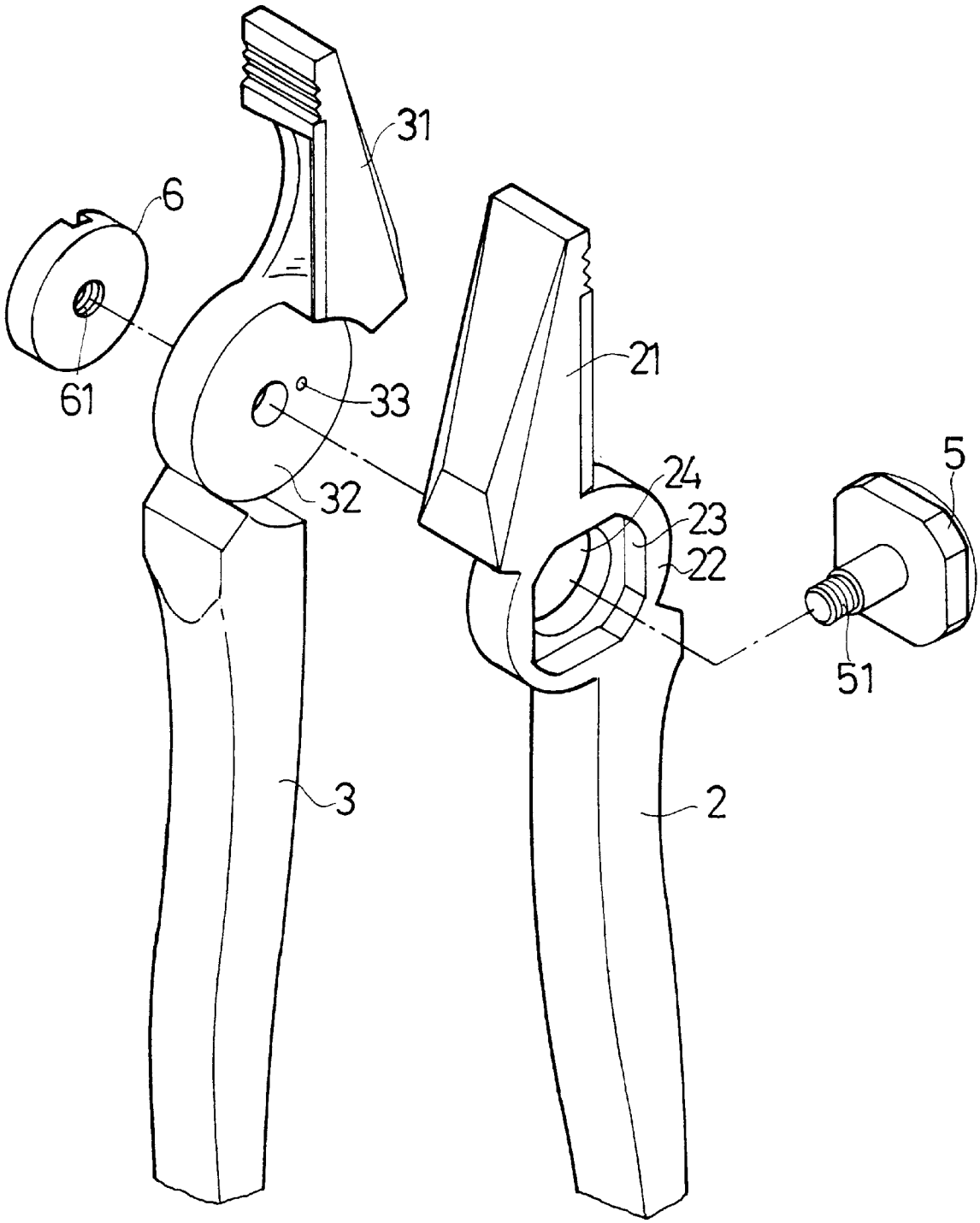
FIG. 3 is a perspective exploded view of the present invention for heat-treatment.
Figure 4:
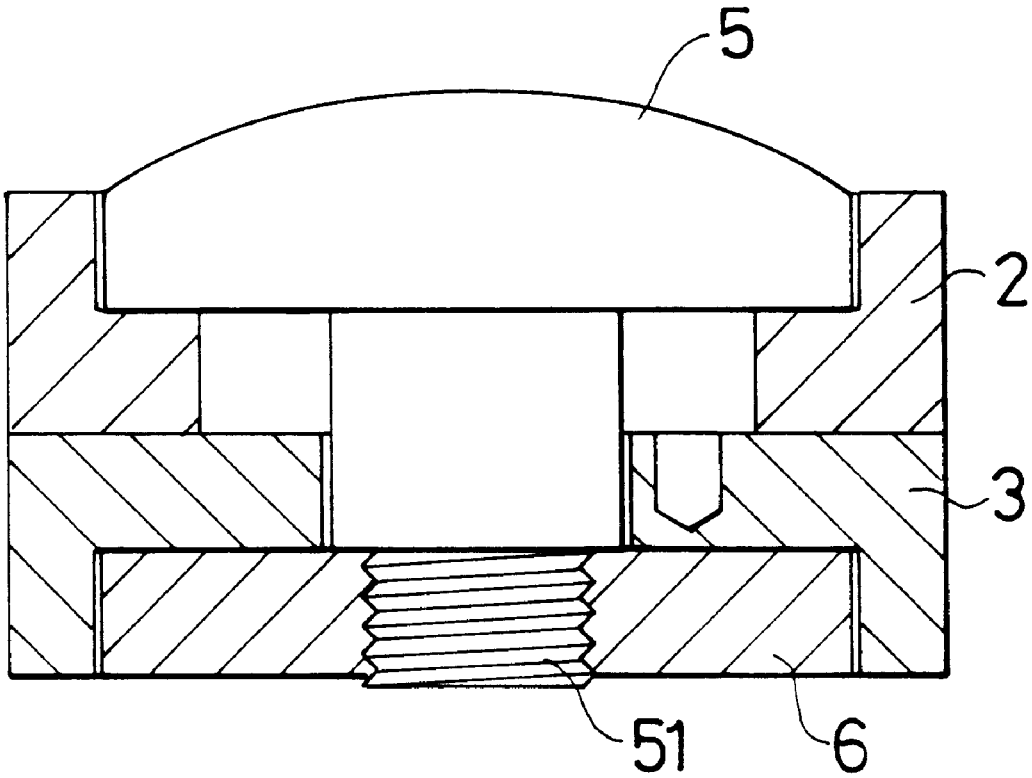
FIG. 4 is a sectional view of the present invention for heat-treatment.

Please refer to FIGS. 1 to 4. The pincers of the present invention includes:

two elongated main bodies 2, 3, a top end of each main body 2, 3 being formed with a jaw section 21, 31, a middle section of each main body 2, 3 being formed with a pivot section 22, 32, the pivot section 22 of one main body 2 being formed with a rectangular recess 23 having a perforation 24, a middle portion of the pivot section 32 of the other main body 3 being formed with a pivot hole 34, the pivot section 32 being further formed with an eccentric locating hole 33;

a fixing member 4 which is a bolt, the fixing member 4 having an enlarged rectangular head sect ion 41, the fixing member 4 passing through the perforation 24 and pivot hole 34 of the main bodies 2, 3 with its head section 41 positioned in the recess 23 of the main body 2, whereby the fixing member 4 and the main body 2 are prevented from rotating relative to each other, the head section 41 of the fixing member 4 being formed with a locating hole 42 facing the pivot section 22, the fixing member 4 being formed with an outer thread 43;

a treatment member 5 which is a bolt having an outer thread 51;

a tightening member 6 which is a nut having an inner thread 61 for screwing with the outer threads 43, 51 of the fixing member 4 and the treatment member 5, one side of the tightening member 6 being formed with a rotary channel 62; and a resilient member 7 which is a torque spring fitted on the fixing member 4, two ends of the resilient member 7 being respectively fitted in the locating holes 33, 42 of the main body 3 and the fixing member 4.

The pivot sections 22, 32 of the two main bodies 2, 3 are mated with each other. The treatment member 5 is passed through the pivot sections 22, 32 of the main bodies 2, 3 and tightened by the tightening member 6. Then the assembly is heat-treated. Thereafter, the treatment member 5 is taken off and the resilient member 7 and the fixing member 4 are placed in with two ends 71 of the resilient member 7 inserted into the locating holes 33, 42 of the main body 3 and the fixing member 4. By means of the rotary channel 62, the tightening member 6 is tightened. Then the thread of the fixing member 4 is damaged so as to prevent the fixing member 4 from rotating due to opening/closing of the pincers. The resilient member 7 is positioned in the main bodies 2, 3 to keep the main bodies 2, 3 in an open (or close) state at normal time. The resilient member 7 pushes one main body 3 and the fixing member 4 which is prevented from rotating relative to the other main body 2, so that the two main bodies 2, 3 are pushed and kept in an open (or close) state at normal time.

After heat-treated, the jaw sections 21, 31 of the pincers can have a hardness meeting the requirement. The main bodies 2, 3 are heat-treated after assembled with the treatment member 5 so that a good mating relationship is maintained between the two main bodies 2, 3. The difference of deformation of the main bodies 2, 3 after heat-treated is minimized so that they can be easily assembled with the blade sections 1 well mated with each other. Two ends of the resilient member 7 are fitted into the locating holes 33, 42 of the main body 3 and the fixing member 4 so that the resilient member 7 can be easily assembled without affecting the mating relationship between the two main bodies 2, 3. In addition, although the material of the resilient member 7 is different from that of the main bodies 2, 3, it will not become cracky after heat-treated. Therefore, after assembled, a good using effect can be achieved.

Figure 5:
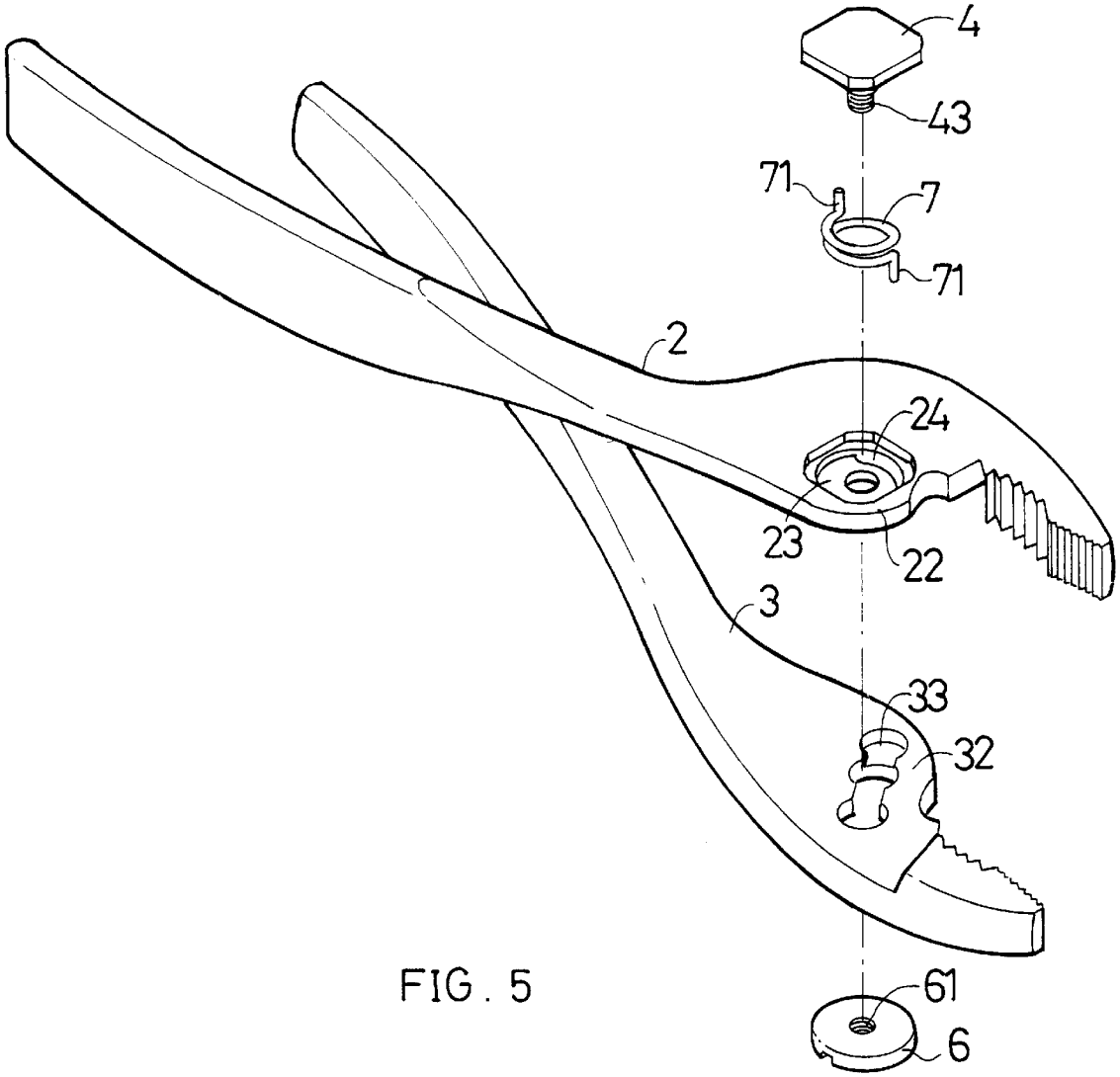
FIG. 5 is a perspective exploded view of a second embodiment of the present invention.
Figure 6:
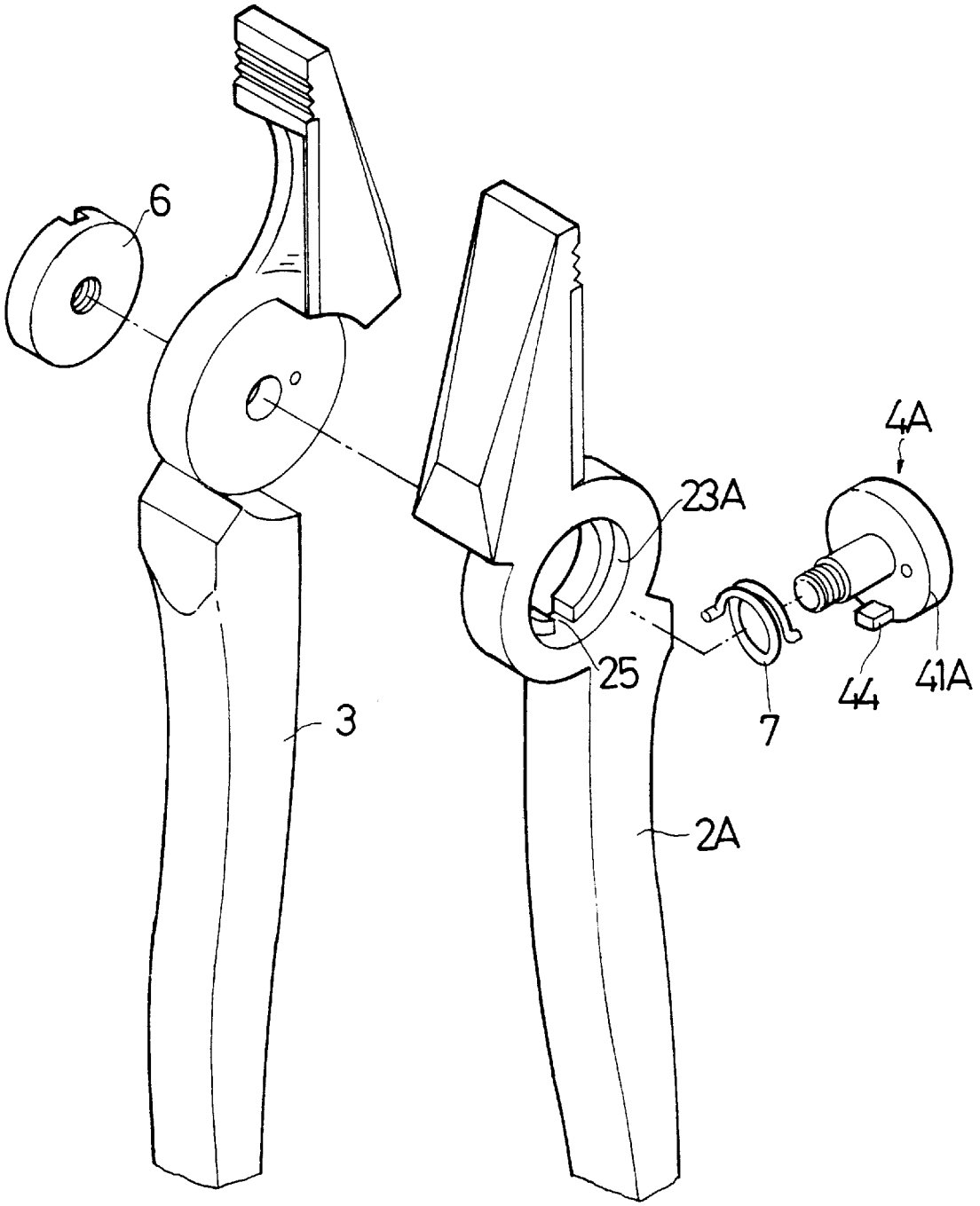
FIG. 6 is a perspective exploded view of a third embodiment of the present invention.
Figure 7:
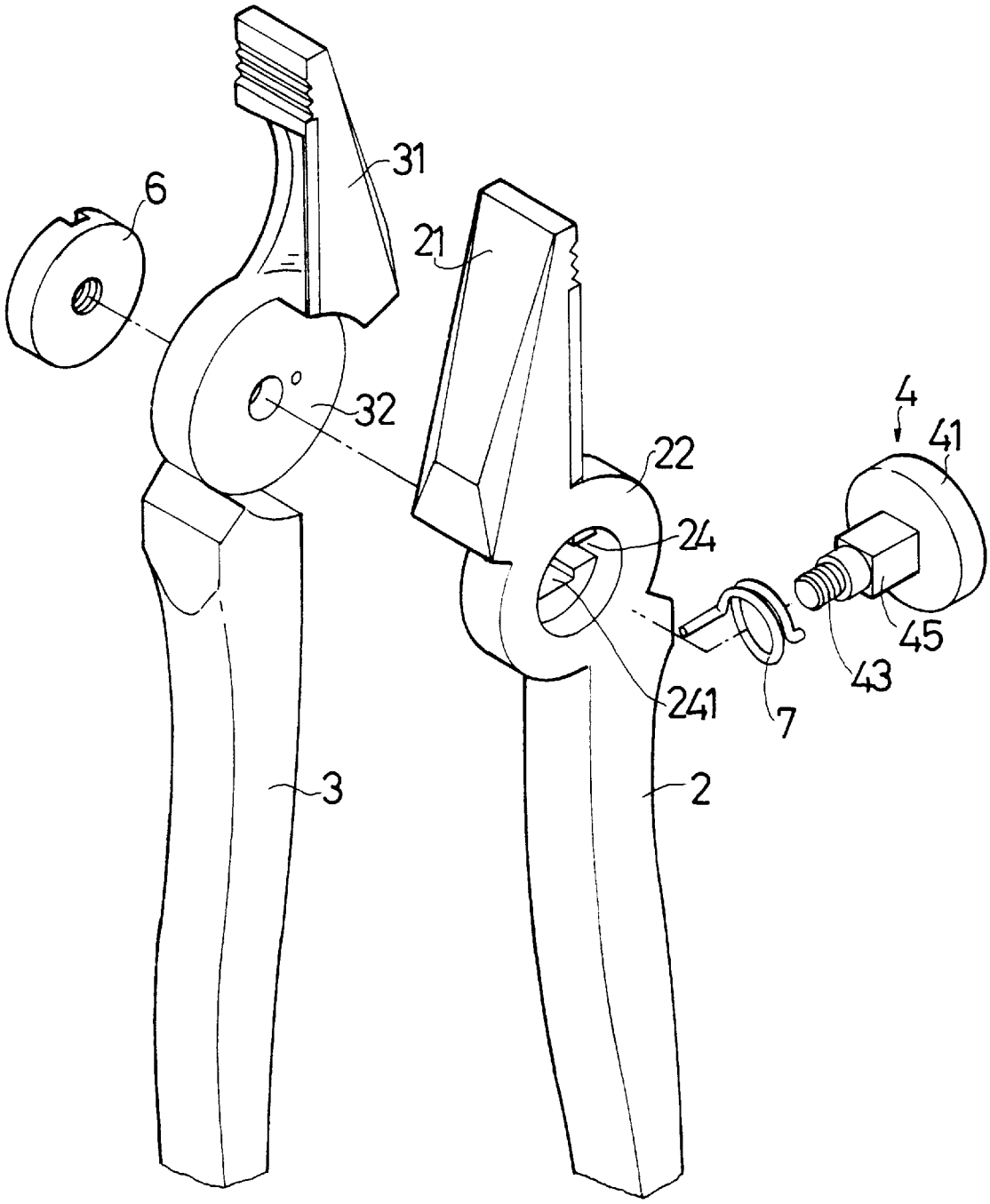
FIG. 7 is a perspective exploded view of a fourth embodiment of the present invention.
Figure 8:
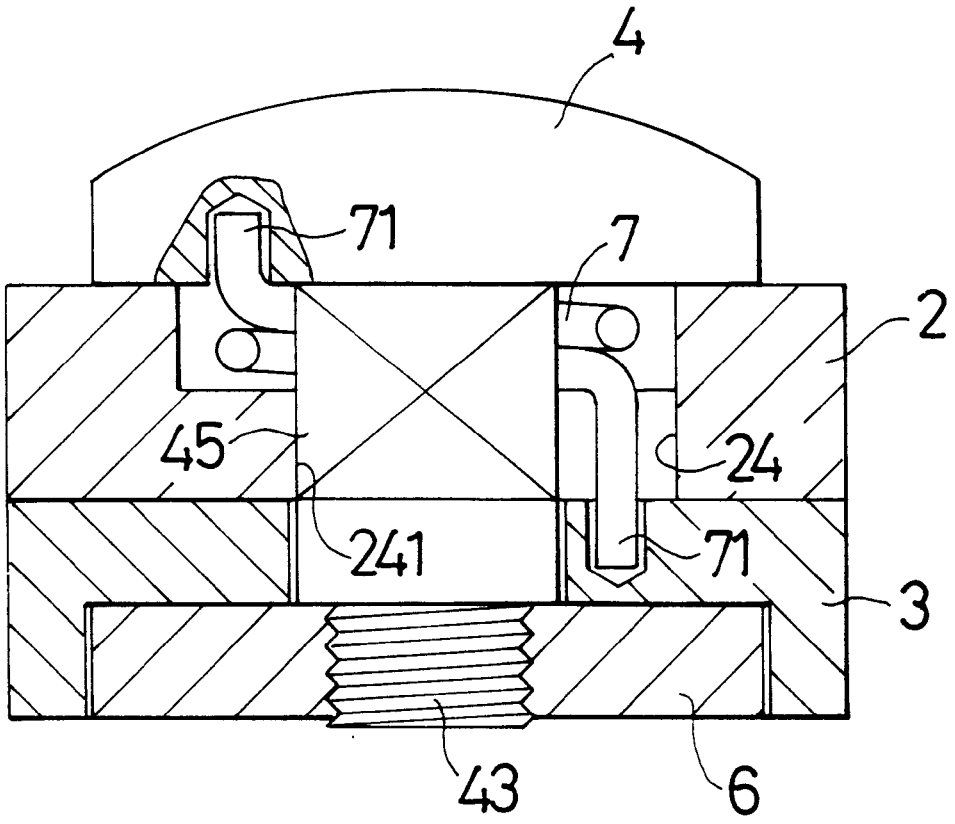
FIG. 8 is a sectional view of a fourth embodiment of the present invention.
Figure 9:
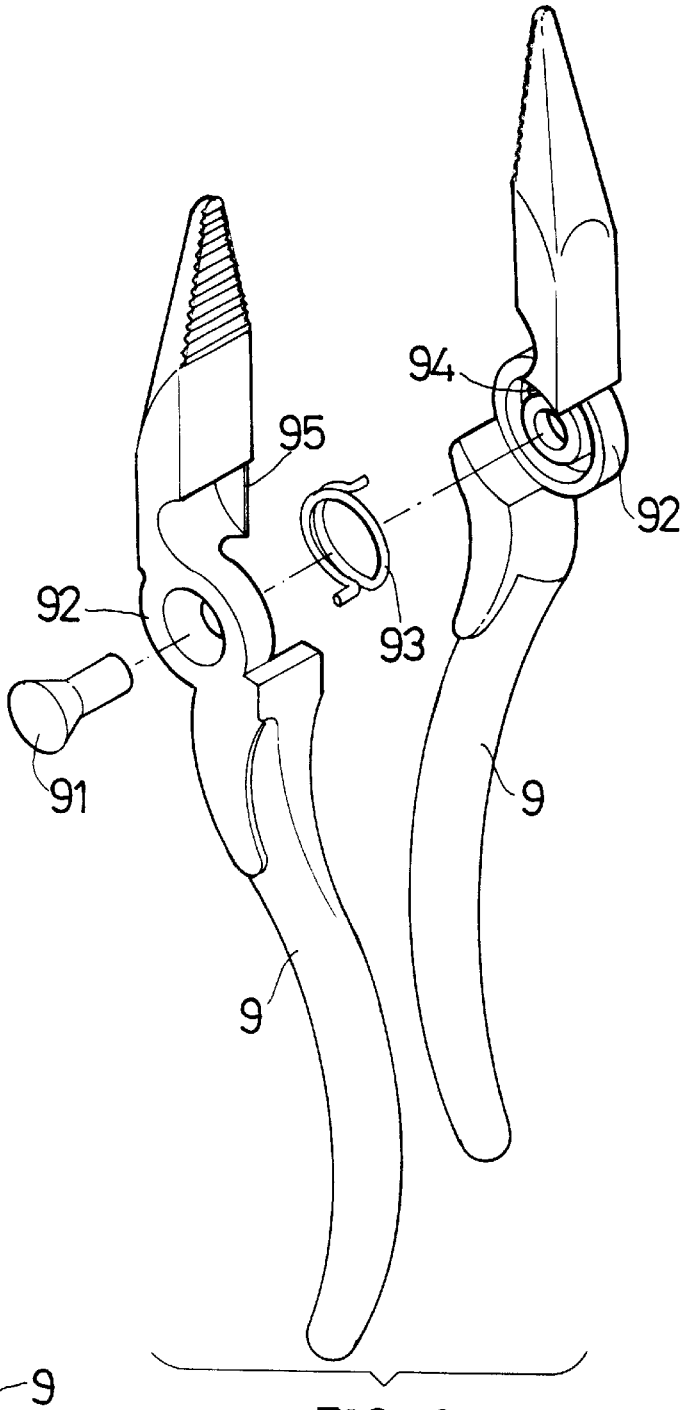
FIG. 9 PRIOR ART
FIG. 9 is a perspective exploded view of a conventional pincers.
Figure 10:
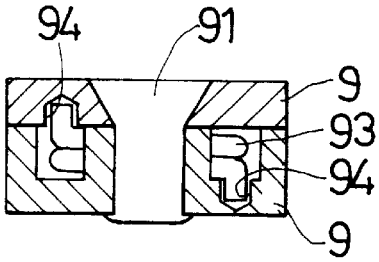
FIG. 10 PRIOR ART
FIG. 10 is a sectional view of the conventional pincers.

FIG. 5 shows a second embodiment of the present invention, which is a water pipe pincers which can be also easily assembled. FIG. 6 shows a third embodiment of the present invention, in which the main body 2A has a circular recess 23A and the fixing member 4A has a circular head section 41A formed with a projection 44. The projection 44 is inserted in a locating notch 25 of the main body 2A so as to prevent the fixing member 4A from rotating relative to the main body 2A. FIGS. 7 and 8 show a fourth embodiment of the present invention, in which the pivot section 22 of the main body 2 is free from any recess and the head section 41 of fixing member 4 protrudes from the main body 2. A top section of the outer thread 43 of the fixing member 4 is formed with a rectangular non-circular section 45 accommodated in a non-circular hole 241 of the perforation 24 of the main body 2, whereby the fixing member 4 is prevented from rotating relative to the main body 2.

In conclusion, by means of the treatment member 5, fixing member 4 and resilient member 7 disposed between the main bodies 2, 3 and the fixing member 4, the present invention has a good mating relationship and can be easily assembled so that the using effect of the pincers is improved.

The above embodiments are only used to illustrate the present invention, not intended to limit the scope thereof. Many modifications of the above embodiments can be made without departing from the spirit of the present invention.

What is claimed is:

1. A pincer tool comprising:

a first elongated main body member having a first upper end and a first pivot section, said first upper end forming a first jaw section, said first pivot section having a first pivot hole and a first locating hole formed therein, said first locating hole displaced from said first pivot hole;

a second elongated main body member having a second upper end and a second pivot section, said second upper end forming a second jaw section, said second pivot section having a non-circular recess formed therein, said non-circular recess having a second pivot hole formed therethrough;

a fixing member having a non-circular head section and a shaft member projecting therefrom, said non-circular head section having a second locating hole formed therein, said shaft member having a first set of screw threads formed thereon;

a resilient member having first and second ends;

a tightening member having a threaded opening formed therethrough, said threaded opening defining an inner surface of said tightening member, said inner surface having a second set of screw threads formed thereon, whereby said first and second elongated main body members are lockingly engaged when said non-circular head section of said fixing member is seated within said non-circular recess and said shaft member projects through said second pivot hole, said second pivot hole further receiving said resilient member, said second end of said resilient member being received within said second locating hole of said non-circular head section and said first end of said resilient member being received within said first locating hole of said first pivot section, said first pivot hole of said first pivot section receiving said shaft member, said shaft member further received within said threaded opening, said first set of screw threads engaging said second set of screw threads.

2. A pincer tool as recited in claim 1 wherein said non-circular head section and said non-circular recess are substantially rectangularly contoured.

* * * * *